US009816457B2

(12) United States Patent
Zhang et al.

(10) Patent No.: US 9,816,457 B2
(45) Date of Patent: Nov. 14, 2017

(54) INTERNAL COMBUSTION ENGINE AND LUBRICATION STRUCTURE THEREOF

(71) Applicants: An Zhang, Beijing (CN); Jianliang Zhang, Beijing (CN)

(72) Inventors: An Zhang, Beijing (CN); Jianliang Zhang, Beijing (CN)

( * ) Notice: Subject to any disclaimer, the term of this patent is extended or adjusted under 35 U.S.C. 154(b) by 9 days.

(21) Appl. No.: 15/188,807

(22) Filed: Jun. 21, 2016

(65) Prior Publication Data

US 2017/0191443 A1 Jul. 6, 2017

(30) Foreign Application Priority Data

Dec. 30, 2015 (CN) ..... 2015 1 1020724
Jan. 15, 2016 (CN) ..... 2016 1 0028641

(51) Int. Cl.
*F01M 9/10* (2006.01)
*F02F 1/00* (2006.01)

(52) U.S. Cl.
CPC ..... *F02F 1/004* (2013.01)

(58) Field of Classification Search
CPC ..... C10N 2020/06; C10N 2030/00; C10N 2030/06; C10N 2270/02; C10N 2040/25; C10M 175/00; C10M 175/0091; F02F 1/004
USPC ..... 123/196 R
See application file for complete search history.

(56) References Cited

U.S. PATENT DOCUMENTS 3,749,072 A * 7/1973 Schweikher ..... F02B 79/00 123/193.2
4,073,966 A * 2/1978 Scholes ..... B05B 5/14 427/473
4,195,976 A * 4/1980 Ryer ..... C07D 263/12 208/48 AA
4,204,968 A * 5/1980 Mack ..... C10M 125/04 508/150

(Continued)

FOREIGN PATENT DOCUMENTS

CN 101880574 A 11/2010
CN 102892981 A 1/2013

(Continued)

OTHER PUBLICATIONS

Chinese First Office Action, Chinese Application No. 201610028641.7, dated Jun. 22, 2016, 10 pages.

(Continued)

*Primary Examiner* — Hung Q Nguyen
(74) *Attorney, Agent, or Firm* — Fenwick & West LLP

(57) ABSTRACT

A lubrication structure of an internal combustion engine is provided according to the present application and configured to lubricate a large particle between components of each of friction pairs of the internal combustion engine. The lubrication structure includes several microstructural bodies being capable of entering into a clearance between the components of each of the friction pairs. Under the action of the microstructural bodies, a plastic deformation of surfaces of each of the friction pairs caused by the large particle can be avoided, thereby, wear of components of the internal combustion engine is decreased, the service life of the internal combustion engine is increased, a load and fuel consumption of the internal combustion engine are decreased, and pollution of the internal combustion engine is reduced.

20 Claims, 3 Drawing Sheets

(56) References Cited

U.S. PATENT DOCUMENTS

| | | | | |
|---|---|---|---|---|
| 4,252,658 | A * | 2/1981 | Tasaka | C10M 111/04 508/115 |
| 4,623,472 | A * | 11/1986 | Jamison | B29C 39/003 508/100 |
| 4,785,775 | A * | 11/1988 | Dekumbis | C23C 4/18 123/193.4 |
| 4,927,549 | A | 5/1990 | Harsanyi et al. | |
| 5,239,955 | A * | 8/1993 | Rao | F02B 77/02 123/193.4 |
| 5,422,321 | A * | 6/1995 | Whalen | C04B 35/565 123/188.1 |
| 5,435,872 | A * | 7/1995 | Penrice | B41F 16/00 123/193.6 |
| 5,469,777 | A * | 11/1995 | Rao | F02F 3/105 123/193.6 |
| 8,598,098 | B2 * | 12/2013 | Nakagawa | B82Y 30/00 508/128 |
| 2011/0303180 | A1 | 12/2011 | Morgan et al. | |
| 2012/0031760 | A1 | 2/2012 | Cheekala et al. | |
| 2013/0130951 | A1 * | 5/2013 | Sinha | C10M 7/00 508/107 |
| 2013/0146009 | A1 | 6/2013 | Pederson et al. | |
| 2015/0175814 | A1 * | 6/2015 | Aizenberg | B08B 17/06 428/312.8 |
| 2017/0191443 | A1 | 7/2017 | Zhang et al. | |

FOREIGN PATENT DOCUMENTS

| | | | |
|---|---|---|---|
| CN | 103146462 | A | 6/2013 |
| CN | 105001941 | A | 10/2015 |
| CN | 105545406 | A | 5/2016 |
| CN | 205477817 | U | 8/2016 |
| DE | 102009031342 | | 1/2011 |
| JP | S 61-213254 | A | 9/1986 |
| JP | 2007009900 | A | 1/2007 |

OTHER PUBLICATIONS

Chinese Notification of Grant of Patent Right for Invention, Chinese Application No. 201610028641.7, dated Aug. 15, 2016, 2 pages.

PCT International Search Report, PCT Application No. PCT/CN2016/112087, dated Apr. 7, 2017, 15 pages.

Chinese First Office Action Chinese Application No. 201610028641.7, dated Jun. 22, 2016, 6 pages (with English Summary).

* cited by examiner

INTERNAL COMBUSTION ENGINE AND LUBRICATION STRUCTURE THEREOF

CROSS REFERENCE TO RELATED APPLICATIONS

This application claims the benefit of priorities to Chinese Patent Application No. 201511020724.3 titled "INTERNAL COMBUSTION ENGINE AND LUBRICATION STRUCTURE THEREOF," filed with the Chinese State Intellectual Property Office on Dec. 30, 2015; and Chinese Patent Application No. 201610028641.7 titled "INTERNAL COMBUSTION ENGINE AND LUBRICATION STRUCTURE THEREOF," filed with the Chinese State Intellectual Property Office on Jan. 15, 2016, the entire disclosures of which are incorporated herein by reference.

FIELD

This application relates to the technical field of internal combustion engines, and particularly to an internal combustion engine and a lubrication structure thereof.

BACKGROUND

When an internal combustion engine is running, components of each of friction pairs (such as a crankshaft journal and a bearing; a camshaft journal and a bearing; a piston ring and a cylinder liner) move with respect to each other at a high speed, and a friction loss occurs in the process of their relative movement. The friction between surfaces of each of the friction pairs not only increases power consumption inside the internal combustion engine but also results in a rapid wear of working surfaces of the components, and heat generated in the friction process may also melt surfaces of some working parts, which causes the internal combustion engine to fail to run normally. Therefore, in order to ensure the normal operation of the internal combustion engine, the surfaces of each of the friction pairs in the internal combustion engine must be lubricated.

Currently, a common lubrication of the friction pairs of the internal combustion engine is to pump a lubricating oil with a certain pressure to a clearance between the friction surfaces of each of the friction pairs by an engine oil pump, to form an oil film which has a certain thickness and will not be ruptured when subjected to a certain mechanical load, thereby completely separating the two components of the friction pair from each other as far as possible, and achieving the lubrication effect.

However, taking the friction pair formed by a piston ring and a cylinder liner as an example, in the working process of the internal combustion engine, a hard and large particle is generally presented in a clearance between the piston ring and the cylinder liner, and the large particle may pierce through the oil film. When the piston ring and the cylinder liner move with respect to each other in a vertical direction, the clearance between the piston ring and the cylinder liner is often zero under the action of a bearing force, which results in that the large particle is subjected to an impact and acts on the piston ring or the cylinder liner. Due to the high hardness of the large particle, when the large particle impacts on the friction pair, smooth surfaces of the piston ring and the cylinder liner may form a protrusion-type plastic deformation, for example, a burr and the like. The presence of the burr further incurs a "Fe—Fe dry friction" between the two components of the friction pair.

The "Fe—Fe dry friction" between the two components of the friction pair results in an accelerated wear between the piston ring and the cylinder liner, a shortened service life of the internal combustion engine, and an increased load and an increased fuel consumption of the internal combustion engine, and an exacerbated pollution of the internal combustion engine. Therefore, the reason of wear of the internal combustion engine is the protrusion-type plastic deformations formed on the surfaces of the components of the friction pairs caused by large particles.

In view of the defects in the above lubrication structure of the friction pairs of the internal combustion engine, it is urgent to provide a lubrication structure of an internal combustion engine, to prevent a large particle between components of a friction pair from causing a protrusion-type plastic deformation of surfaces of the components of the friction pair when the large particle is subjected to an impact.

SUMMARY

In order to address the technical issues described above, a first object of the present application is to provide a lubrication structure of an internal combustion engine, which includes several microstructural bodies provided between components of a friction pair and configured to lubricate a large particle between the components of the friction pair of the internal combustion engine, to prevent the large particle from causing a protrusion-type plastic deformation of surfaces of the components of the friction pair, thereby decreasing wear of components of the internal combustion engine, increasing the service life of the internal combustion engine, decreasing a load and fuel consumption of the internal combustion engine, and reducing pollution of the internal combustion engine. A second object of the present object is to provide an internal combustion engine.

In order to achieve the first object of the present application, a lubrication structure of an internal combustion engine is provided according to the present application, which is configured to lubricate a large particle between components of a friction pair of the internal combustion engine, wherein the lubrication structure includes a plurality of microstructural bodies configured to enter into a clearance between the components of the friction pair, and a surface of each of the microstructural bodies is provided with a plurality of recesses.

In the present application, when the internal combustion engine is running, due to the presence of the microstructural bodies, the impact force exerted on the surfaces of the components of the friction pair by the large particle is reduced significantly when the clearance between the components of the friction pair is reduced suddenly (for example, in the case that the automobile is in a critical friction state, such as accelerating, braking, climbing, overloading). Thus, the surfaces of the components of the friction pair merely generate elastic deformation under the action of the impact force of the large particle, rather than protrusion-type plastic deformation, and thereby, "Fe—Fe dry friction" between the surfaces of the components of the friction pair caused by the protrusion-type plastic deformation is avoided, and wear between the components of the friction pair is further reduced, service life of the internal combustion engine is increased, a load and fuel consumption of the internal combustion engine are decreased, and pollution of the internal combustion engine is reduced.

Optionally, each of the recesses has a depth ranging from 1/150 to 1/3 of a characteristic dimension of the microstructural body.

Optionally, the microstructural body is a microsphere.

Optionally, the microstructural body has a diameter ranging from 0.0101 μm to 60 μm.

Optionally, the microstructural body is a micro-cylinder.

Optionally, the microstructural body is a micro-cube.

Optionally, a weight of the plurality of microstructural bodies ranges from 0.1 g to 1000 g.

Optionally, the microstructural body is a ceramic structure.

In order to achieve the second object of the present application, an internal combustion engine is further provided according to the present application, which includes several friction pairs with components of each of the friction pairs being movable with respect to each other and an engine oil pool configured to accommodate engine oil, a lubrication structure configured to lubricate a large particle between components of each of the friction pairs of the internal combustion engine is provided in the engine oil pool, and the lubrication structure is configured to enter into a clearance between the components of each of the friction pairs. The lubrication structure is the lubrication structure described above.

Figure 1:
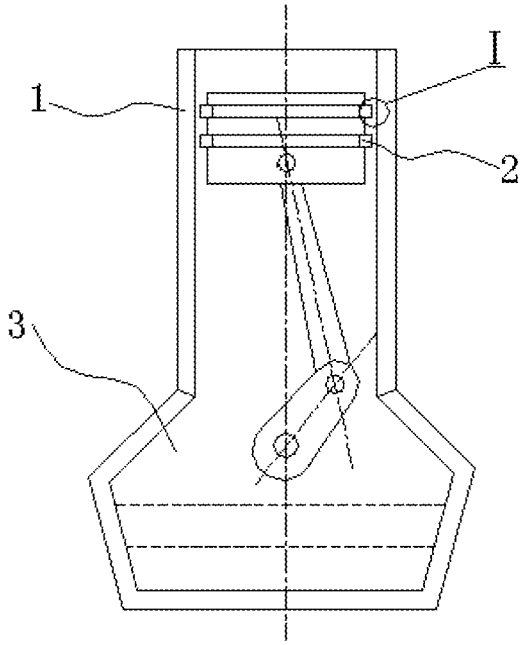
FIG. 1 is a schematic view showing the structure of an embodiment of a lubrication structure of an internal combustion engine according to the present application.

Reference numerals in FIGS. 1 to 5:

| | | | |
|---|---|---|---|
| 1 | cylinder liner, | 2 | piston ring, |
| 3 | engine oil pool, | 4 | large particle, |
| 5 | microstructural body, | 51 | recess, |
| A | elastic deformation curve of cylinder liner, | D | diameter, |
| B | elastic deformation curve of piston ring, | | |
| L | side length, | | |
| t | depth of the recess. | | |

DETAILED DESCRIPTION

In order to make those skilled in the art better understand the technical solution of the present application, the present application is further described in detail hereinafter in conjunction with drawings and specific embodiments.

Figure 2:
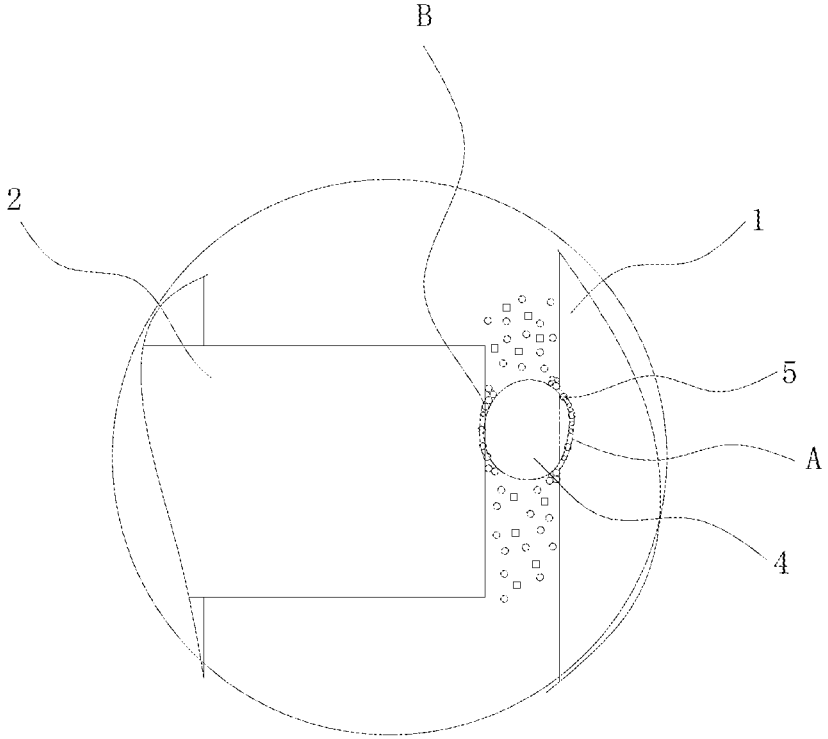
FIG. 2 is a partial enlarged view of part I in FIG. 1.
Figure 3A:
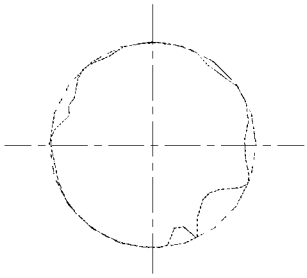
FIG. 3*a* is a schematic view showing the structure of a first embodiment of the microstructural body in FIG. 1 according to the present application.
Figure 3B:
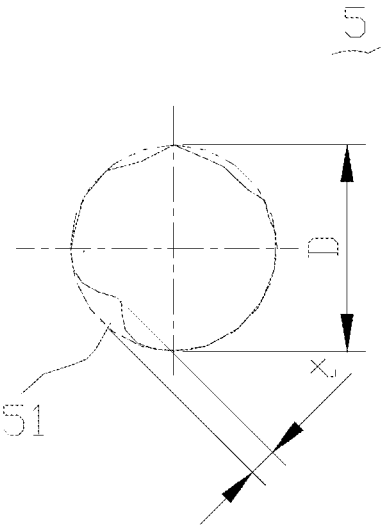
FIG. 3*b* is a side view of FIG. 3*a;*
Figure 4A:
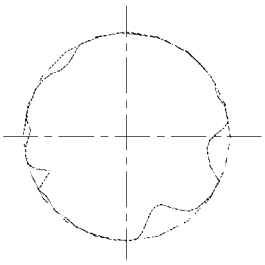
FIG. 4*a* is a schematic view showing the structure of a second embodiment of the microstructural body in FIG. 1 according to the present application.
Figure 4B:
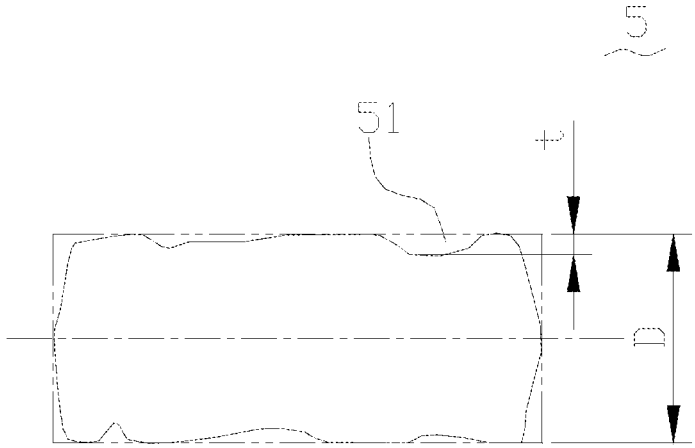
FIG. 4*b* is a side view of FIG. 4*a;*
Figures 5A, 5B:
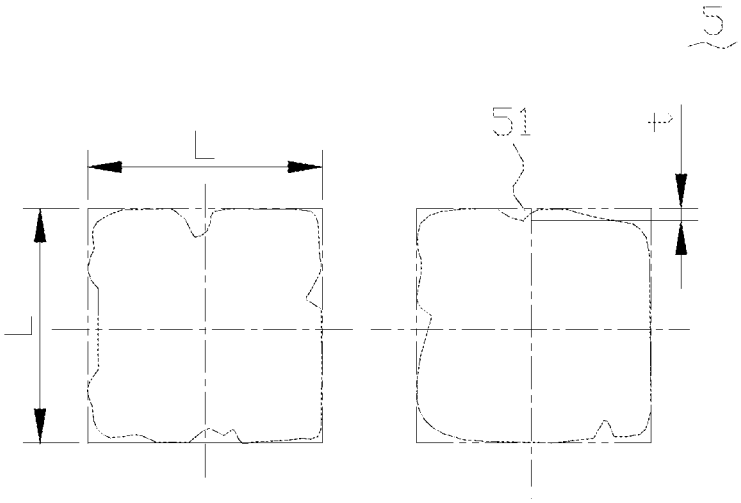
FIG. 5*a* is a schematic view showing the structure of a third embodiment of a microstructural body in FIG. 1 according to the present application.
FIG. 5*b* is a side view of FIG. 5*a*.

Reference is made to FIGS. 1 and 2, FIG. 1 is a schematic view showing the structure of an embodiment of a lubrication structure of an internal combustion engine according to the present application; and FIG. 2 is a partial enlarged view of part I in FIG. 1.

In an embodiment, a lubrication structure of an internal combustion engine is provided according to the present application, and is configured to lubricate a large particle 4 between each of friction pairs of the internal combustion engine. As shown in FIG. 2, the lubrication structure includes several microstructural bodies 5 which can enter into a clearance between each of the friction pairs.

The microstructural body 5 refers to a microstructure which is observable only by means of an optical microscope or an electron microscope and is different from various macroscopic structures observable by the naked eye.

In a conventional lubrication structure of the internal combustion engine, a large particle is presented between a piston ring and a cylinder liner, and when the piston ring and the cylinder liner move with respect to each other in a vertical direction, the clearance between the friction pair is reduced suddenly under the action of a bearing force (in the case that the automobile is in a critical friction state, such as accelerating, braking, climbing, overloading), which causes the large particle to exert an impact force on surfaces of the components of the friction pair. The large particle, when being subjected to an impact, not only pierces through an oil film, but also acts on the piston ring or the cylinder liner. The large particle has a high hardness, and further the surface hardness of the friction pair is instantaneously decreased due to the temperature reaching up to 1600 Celsius degrees or higher instantaneously within the cylinder, thus when the large particle impacts on the surfaces of the friction pair, a protrusion-type plastic deformation, such as a burr and the like, is generated on the smooth surfaces of the piston ring and the cylinder liner. The presence of the burr further incurs a "Fe—Fe dry friction" between the two components of the friction pair.

The "Fe—Fe dry friction 1" between the two components of the friction pair results in an accelerated wear between the piston ring and the cylinder liner, a shortened service life of the internal combustion engine, an increased load and increased fuel consumption of the internal combustion engine, and an exacerbated pollution of the internal combustion engine.

Before the internal combustion engine according to this embodiment starts to work, several microstructural bodies 5 are directly or indirectly put in an engine oil pool 3, to allow the microstructural bodies 5 to enter into a clearance between each of the friction pairs of the internal combustion engine along with a lubricating oil, and a friction pair constituted by a piston ring 2 and a cylinder liner 1 is described as an example.

As shown in FIGS. 1 and 2, when the internal combustion engine is running, the piston ring 2 moves in the cylinder liner 1 in the vertical direction, the lubricating oil and the microstructural bodies 5 enter into a clearance between the piston ring 2 and the cylinder liner 1. The microstructural bodies 5 and the large particle 4 all move in a direction towards the cylinder liner 1 or the piston ring 2, and since each of the microstructural bodies 5 has a large surface tension for engaging with the large particle 4, each of the microstructural bodies 5 is located closer to the surface of the cylinder liner 1 or the surface of the piston ring 2 than the large particle 4, i.e., several microstructural bodies 5 cling to the large particle 4 and are located between the cylinder liner 1 and the piston ring 2.

On this basis, due to the presence of the microstructural bodies 5, when the clearance between the cylinder liner 1 and the piston ring 2 is zero under the action of a bearing force, the lubrication structure formed by the microstructural bodies 5 moderates and decreases the impact force on the surfaces of the components of the friction pair exerted by the large particle 4, and the surfaces of the friction pair merely generate elastic deformation under the action of the impact force of the large particle 4, rather than protrusion-type plastic deformation. Further, due to the instantaneous high temperature above 1600 Celsius degrees in the cylinder, the instantaneous elasticity index of the surfaces of the components of the friction pair is also increased. The elastic deformations are shown by a deformation curve A of the cylinder liner and a deformation curve B of the piston ring in FIG. 2, and the "Fe—Fe dry friction" between the surfaces of the components of the friction pair caused by the plastic deformation is avoided, and further the wear between the two components of the friction pair is reduced, the service life of the internal combustion engine is improved, and the load and fuel consumption of the internal combustion engine is decreased and the pollution of the internal combustion engine is reduced.

It is to be noted that, the lubrication structure in this embodiment is different from a solid lubrication commonly used in the field. The conventional solid lubrication is to utilize solid powder, a coated film, a composite material, and the like to separate friction surfaces in contact with each other, to achieve the purpose of lubrication. Therefore, in the conventional solid lubrication, a solid lubricating film is formed on each of the two surfaces of the friction pair, and the wear occurs between the solid lubricating films and not between the surfaces of the friction pair, thereby lubricating the friction pair. The microstructural bodies 5 in this embodiment achieve the purpose of lubrication by preventing the large particle 4 from causing a plastic deformation of the surfaces of the friction pair, and its lubrication process is directed at the large particle 4 between the two surfaces of the friction pair. Therefore, objects and principles of the technical solution of the present application and the conventional solid lubrication are different.

Reference is further made to FIGS. 3 to 5, FIG. 3*a* is a schematic view showing the structure of a first embodiment of a microstructural body in FIG. 1 according to the present application; FIG. 3*b* is a side view of FIG. 3*a*; FIG. 4*a* is a schematic view showing the structure of a second embodiment of a microstructural body in FIG. 1 according to the present application; FIG. 4*b* is a side view of FIG. 4*a*; FIG. 5*a* is a schematic view showing the structure of a third embodiment of a microstructural body in FIG. 1 according to the present application; and FIG. 5*b* is a side view of FIG. 5*a*.

As shown in FIGS. 3 to 5, the microstructural body 5 may have a shape of a microsphere, a micro-cylinder or a micro-cube, and a surface of the microstructural body 5 is provided with several recesses 51. Also, each recess has a depth t ranging from 1/150 to 1/3 of the characteristic dimension of the microstructural body 5.

For the microstructural body 5 having a microsphere shape, the characteristic dimension refers to a diameter D as shown in FIG. 3, and $1/150 \leq t/D \leq 1/3$.

For the microstructural body 5 having a micro-cylinder shape, the characteristic dimension refers to a diameter D as shown in FIG. 4, and $1/150 \leq t/D \leq 1/3$.

For the microstructural body 5 having a micro-cube shape, the characteristic dimension refers to a side length L as shown in FIG. 5, and $1/150 \leq t/L \leq 1/3$.

The working process of the microstructural body 5 is described as follow. When the microstructural body 5 is subjected to an impact force from the large particle 4, macroscopically, the lubrication structure formed by multiple microstructural bodies 5 decreases the impact pressure and impact force applied by the large particle 4. Microscopically, the recesses 51 of the microstructural body 5 not only allow the microstructural body 5 to cling to and engage with the large particle 4 at any time, but also allow the microstructural body 5 to tightly engage with the large particle 4 under the action of the impact force at this point, and then allow a relative creeping motion between the microstructural body 5 and the large particle 4 to occur all the time, thereby dispersing and reducing the impact force and energy on the surfaces of the friction pair exerted by the large particle 4, and achieving the lubrication of the large particle 4.

In this embodiment, since the surface of the microstructural body 5 is provided with several recesses 51, the specific surface area of the microstructural body 5 is large, and the surface of the microstructural body 5 has a structure with a strong surface tension, and is capable of cleaning up impurities such as oil sludge, paint sheet, floccule and the like, in the engine oil of the internal combustion engine, which decreases the lubricity of the engine oil. As a result, the service life of the engine oil is increased by making the best use of the engine oil, and engine oil can be refilled rather than being replaced, thus the engine oil does not need to be replaced in maintenance of an automobile.

Preferably, the recess 51 has a depth ranging from 1/150 to 1/3 of the characteristic dimension of the microstructural body 5, and in the case that the depth t of the recess is in this range, the lubrication effect is best. Similarly, the depth of the recess 51 is not limited to this, and may also be set arbitrarily according to practical requirements. In the case that the depth of the recess 51 is in a reasonable range, each of the microstructural bodies 5 has a large specific surface area. Thus, the shape and the depth of the recess 51 are not limited herein.

It is to be noted that, in the above embodiments, the microstructural body 5 having a structure of a microsphere, a micro-cylinder, a micro-cube or the like means that a body structure of the microstructural body 5 is of the above shapes, such as the shapes indicated by dotted lines shown in FIGS. 3 to 5, and the surface of each of the body structures is provided with several recesses 51. Further, since the microstructural body 5 is a structure in which several recesses 51 are provided in a sphere, a cylinder or a cube, the specific shape of the microstructural body 5 is defined as the microsphere, the micro-cylinder or the micro-cube.

Meanwhile, each of the above microstructural bodies 5 has a diameter ranging from 0.0101 μm to 60 μm, and preferably from 0.101 μm to 60 μm. Apparently, the microstructural bodies 5 in the above embodiments may also be a microstructural-body agglomerate composed of several microstructural bodies 5. When the internal combustion engine is running, the microstructural-body agglomerate is separated into several microstructural bodies 5 under the action of slight pressing forces, without causing wear, applied by the friction pairs.

Similarly, in this embodiment, the dimensions, such as a diameter or a side length, of each of the microstructural bodies 5 are not limited to this, and may also be set arbitrarily as required. The dimensions of the microstructural bodies 5 within a reasonable range all fall into the scope of the present application.

Preferably, the microstructural body 5 may be embodied to have different diameters according to various powers of internal combustion engines. For example, for an ultra-large scale internal combustion engine, the microstructural body 5 may have a diameter ranging from 14.001 μm to 60 μm. For a large-scale internal combustion engine, the microstructural body 5 may have a diameter ranging from 9.001 μm to 14 μm. For a medium-sized internal combustion engine, the microstructural body 5 may have a diameter ranging from 5.001 μm to 9 μm. For a small-sized internal combustion engine, the microstructural body 5 may have a diameter ranging from 0.301 μm to 5 μm. For a micro internal combustion engine, the microstructural body 5 may have a diameter ranging from 0.101 μm to 0.3 μm.

The above microstructural bodies 5 placed in the lubricating oil have a total weight ranging from 0.1 g to 1000 g. It may be appreciated that, the microstructural bodies 5 in this weight range are a collection of the several microstructural bodies 5 provided between each of the friction pairs. The weight of the microstructural bodies 5 varies as characteristics of the internal combustion engine, and may be set arbitrarily according to practical requirements, which is also not limited here.

More specifically, in the above embodiments, the microstructural body 5 is of a ceramic structure.

As shown in FIG. 2, in order to prevent the large particle 4 from causing a plastic deformation of the surfaces of the friction pair under the action of a pressing force of the friction pair, the microstructural body 5 is required to have a certain hardness. It may be appreciated that, the microstructural body 5 is not limited to be made of ceramic or metal, but may also be made of other common materials in the field, which is not limited here.

Further, an internal combustion engine is further provided according to the present application, which includes several friction pairs with components of each of the friction pairs being movable with respect to each other, and a lubrication structure is provided between each of the friction pairs. The lubrication structure is the lubrication structure described in any one of the above embodiments. Since the above lubrication structure has the above technical effects, the internal combustion engine provided with the lubrication structure also has the corresponding technical effects, which will not be described here.

Generally, the fuel consumption of an internal combustion engine of an automobile takes up 70% of the total fuel consumption of the automobile, i.e., the fuel consumption for useful work of the automobile is less than 30% of the total fuel consumption of the automobile. In various internal consumptions of the internal combustion engine of an automobile, reducing the load of friction and wear is an important trend for fuel saving in the field of automobiles.

The internal combustion engine and the lubrication structure thereof according to the present application are described in detail hereinbefore. The principle and the embodiments of the present application are illustrated herein by specific examples. The above description of the examples is only intended to help the understanding of the method and idea of the present application. It should be noted that, for the person skilled in the art, a few of modifications and improvements may be made to the present application without departing from the principle of the present application, and these modifications and improvements are also deemed to fall into the scope of the present application defined by the claims.

What is clamed is:

1. An internal combustion engine, comprising a plurality of friction pairs with components of each of the friction pairs being movable with respect to each other, and further comprising an engine oil pool configured to accommodate engine oil, wherein a lubrication structure configured to lubricate a large particle between the components of each of the friction pairs of the internal combustion engine is provided in the engine oil pool, and the lubrication structure is configured to enter into a clearance between the components of each of the friction pairs, and the lubrication structure comprises a plurality of microstructural bodies configured to enter into a clearance between the components of the friction pair, and a surface of each of the microstructural bodies is provided with a plurality of recesses.

2. The internal combustion engine according to claim 1, wherein the microstructural body is a microsphere, and each of the recesses has a depth ranging from 1/150 to 1/3 of a diameter of the microstructural body.

3. The internal combustion engine according to claim 1, wherein the microstructural body is a micro-cylinder, and each of the recesses has a depth ranging from 1/150 to 1/3 of a diameter of the microstructural body.

4. The internal combustion engine according to claim 1, wherein the microstructural body is a micro-cube, and each of the recesses has a depth ranging from 1/150 to 1/3 of a side length of the microstructural body.

5. A lubrication structure of an internal combustion engine, configured to lubricate a large particle between components of a friction pair of the internal combustion engine, wherein the lubrication structure comprises a plurality of microstructural bodies configured to enter into a clearance between the components of the friction pair, and a surface of each of the microstructural bodies is provided with a plurality of recesses.

6. The lubrication structure according to claim 5, wherein the microstructural body is a microsphere, and each of the recesses has a depth ranging from 1/150 to 1/3 of a diameter of the microstructural body.

7. The lubrication structure according to claim 6, wherein a weight of the plurality of microstructural bodies ranges from 0.1 g to 1000 g.

8. The lubrication structure according to claim 6, wherein the depth of each of the recesses ranges from 1/50 to 1/5 of the diameter of the microstructural body.

9. The lubrication structure according to claim 8, wherein a weight of the plurality of microstructural bodies ranges from 0.1 g to 1000 g.

10. The lubrication structure according to claim 8, wherein the diameter of the microstructural body ranges from 0.0101 μm to 60 μm.

11. The lubrication structure according to claim 10, wherein a weight of the plurality of microstructural bodies ranges from 0.1 g to 1000 g.

12. The lubrication structure according to claim 10, wherein the diameter of the microstructural body ranges from 0.101 μm to 60 μm.

13. The lubrication structure according to claim 5, wherein the microstructural body is a micro-cylinder, and each of the recesses has a depth ranging from 1/150 to 1/3 of a diameter of the microstructural body.

14. The lubrication structure according to claim 13, wherein the depth of each of the recesses ranges from 1/50 to 1/5 of the diameter of the microstructural body.

15. The lubrication structure according to claim 13, wherein a weight of the plurality of microstructural bodies ranges from 0.1 g to 1000 g.

16. The lubrication structure according to claim 5, wherein the microstructural body is a micro-cube, and each of the recesses has a depth ranging from 1/150 to 1/3 of a side length of the microstructural body.

17. The lubrication structure according to claim 16, wherein the depth of each of the recesses ranges from 1/50 to 1/5 of the side length of the microstructural body.

18. The lubrication structure according to claim 16, wherein a weight of the plurality of microstructural bodies ranges from 0.1 g to 1000 g.

19. The lubrication structure according to claim 5, wherein a weight of the plurality of microstructural bodies ranges from 0.1 g to 1000 g.

20. The lubrication structure according to claim 5, wherein the microstructural body is a ceramic structure.

* * * * *